US010317170B2

(12) United States Patent
Wu

(10) Patent No.: US 10,317,170 B2
(45) Date of Patent: Jun. 11, 2019

(54) PYROTECHNIC LAUNCHING SYSTEM WITH RIFLED MORTAR

(71) Applicant: Kevin Wu, Hong Kong (CN)

(72) Inventor: Kevin Wu, Hong Kong (CN)

(73) Assignee: Titan International Technologies, Ltd., Hong Kong (CN)

( * ) Notice: Subject to any disclaimer, the term of this patent is extended or adjusted under 35 U.S.C. 154(b) by 0 days.

(21) Appl. No.: 15/858,259

(22) Filed: Dec. 29, 2017

(65) Prior Publication Data

US 2018/0188003 A1 Jul. 5, 2018

Related U.S. Application Data

(60) Provisional application No. 62/440,264, filed on Dec. 29, 2016.

(51) Int. Cl.

| | |
|---|---|
| ***F42B 4/20*** | (2006.01) |
| ***F41F 1/06*** | (2006.01) |
| ***F42B 4/00*** | (2006.01) |

(52) U.S. Cl.

CPC ..... *F41F 1/06* (2013.01); *F42B 4/00* (2013.01); *F42B 4/20* (2013.01)

(58) Field of Classification Search

CPC ..... F41F 1/06; F42B 4/20

See application file for complete search history.

(56) References Cited

U.S. PATENT DOCUMENTS

| | | | | |
|---|---|---|---|---|
| 2,325,560 A * | 7/1943 | Jean Wauters | F41F 1/06 | 102/373 |
| 3,779,128 A * | 12/1973 | Pelaez | F41F 3/048 | 89/1.3 |
| 6,286,429 B1 * | 9/2001 | Marietta | F41F 1/06 | 102/342 |
| 6,393,990 B1 * | 5/2002 | Fagan | F41F 1/06 | 102/342 |
| 6,457,415 B1 * | 10/2002 | Peter Sung Yan | F42B 4/22 | 102/361 |

(Continued)

FOREIGN PATENT DOCUMENTS

| | | | |
|---|---|---|---|
| CN | 1693835 A * | 11/2005 | F42B 4/14 |
| GB | 191414848 A * | 6/1916 | F41A 19/58 |

(Continued)

*Primary Examiner* — Joshua T Semick

(74) *Attorney, Agent, or Firm* — Womble Bond Dickinson (US) LLP

(57) ABSTRACT

A fireworks launcher assembly can include a sleeve having a cavity defined therethrough, and a firing tube at least partially received within in the cavity of the sleeve. The firing tube can comprising a passage defined therethrough and plurality of rifling features defined about an interior surface thereof. The plurality of rifling features can cause one or more aerial shells loaded into and launched from the firing tube to rotate as the one or more aerial shells move along the firing tube during launching thereof. A wadding insert further can be received at least partially within the passage of the firing tube, and a base portion can be connected to a lower end of the firing tube to maintain the launching assembly in a generally upright orientation before, during, and/or after launching of the one or more aerial shells therefrom.

7 Claims, 12 Drawing Sheets

(56) References Cited

U.S. PATENT DOCUMENTS

| | | | | |
|---|---|---|---|---|
| 6,851,371 | B1 * | 2/2005 | Wah | F42B 4/20<br>102/343 |
| 7,757,607 | B1 * | 7/2010 | Deye | F41F 1/06<br>102/206 |
| 8,365,667 | B2 * | 2/2013 | Marietta | F41F 1/06<br>102/343 |
| 9,885,549 | B2 * | 2/2018 | Marietta | F42B 4/02 |
| 2003/0127010 | A1 * | 7/2003 | O'Dwyer | F42B 4/24<br>102/335 |

FOREIGN PATENT DOCUMENTS

| | | | | |
|---|---|---|---|---|
| GB | 239707 A | * | 9/1925 | F42B 4/22 |
| GB | 1228785 A | * | 4/1971 | F41F 1/06 |

* cited by examiner

PYROTECHNIC LAUNCHING SYSTEM WITH RIFLED MORTAR

CROSS-REFERENCE TO RELATED APPLICATIONS

The present Patent Application claims the benefit of U.S. Provisional Patent Application No. 62/440,264 filed Dec. 29, 2016.

INCORPORATION BY REFERENCE

The disclosure of U.S. Provisional Patent Application No. 62/440,264 filed Dec. 29, 2016, is hereby incorporated by reference as if presented herein in its entirety.

SUMMARY

In one aspect, the present disclosure is directed to a pyrotechnic or firework launching system. The pyrotechnic launching system can include a launcher and one or more aerial shells configured to be launched or fired from the launcher. The launcher typically comprises an elongated body having a tubular or cylindrical shape, with a cavity or passage defined at least partially through the launcher body that is configured to receive the one or more aerial shells. The launcher body can include an interior surface adjacent or proximate to the cavity or passage. The launcher body additionally can include one or more rifled portions or rifling features defined along the interior surface of the launcher body. The rifled portion(s) can comprise one or more grooves or channels defined about the interior surface of the launcher body. The one or more grooves or channels can be arranged in a spiral or helical pattern, for example, at least partially along the interior surface of the launcher body. In one aspect, the grooves or channels may cause the aerial shell(s) to spin or rotate as the aerial shell(s) moves along the launcher body during launching/firing thereof. The rotation or spin of the aerial shells, for example, can result in higher and/or more controlled flight paths, especially in comparison to aerial shells fired from launchers having smooth or continuous bores or interior surfaces, i.e., launchers without rifling.

In another aspect, the aerial shell(s) can include a lift portion and an effects portion. The lift portion can comprise a tubular body that at least partially defines an interior chamber. The interior chamber of the lift portion can at least partially receive a lift charge or propellant operable to generate combustion gases that force or propel the aerial shell(s) along and out of the launcher body and which aerial shell(s) can proceed upward, e.g. to a predetermined height. The effects portion can include a generally spherical body that at least partially defines an interior chamber. The interior chamber of the effects portion typically at least partially receives a breaking charge and one or more effects charges. The breaking charge can be operable to at least partially break or open a sidewall of the spherical body to release the effects charge(s). The effects charge(s) can be operable to generate a predetermined effect, such as a specific shape or noise signature. The increased height and/or control of the aerial shells provided by the rifled launcher can, for example, allow the aerial shell to require less (i.e., a reduced amount of) propellant in comparison to aerial shells fired from a launcher without rifling. For example, the aerial shells according to the present disclosure can use about 5% to about 15% less propellant or lift charge in comparison to aerial shells used with/fired from launchers without rifling. The reduction in the percentage of the lift charge required can provide several additional benefits. For example, utilizing less charge in a typical sized shell can allow space for additional effects charge and further allow, for example, more complex patterns or effects. In one example, while fireworks for personal use generally do not include a sufficient amount of effects charge to allow for complex patterns, e.g., patterns other than spherical shapes, the launcher detailed in the present disclosure can provide fireworks that have complex effects patterns.

In yet another aspect, a launcher assembly can be provided. The launcher assembly can include an outer portion comprising a sleeve having a body with a cavity defined therethrough. The launcher assembly further can include at least one insert portion comprising a firing tube having a generally cylindrical shape that is sized, configured, and/or dimensioned to be at least partially received within the cavity of the sleeve. The firing tube can have a passage defined therethrough that is sized, dimensioned, and/or otherwise configured for receipt of one or more aerial shells to facilitate firing thereof. The firing tube further can have a plurality of rifling features or rifled portions defined about an interior surface of the firing tube. The interior surface can extend along or can be substantially adjacent to the passage of the firing tube. In one embodiment, the plurality of rifling features can include one or more channels or grooves defined in and along the interior surface of the firing tube. The channels or grooves can be recessed at a prescribed depth in relation to the interior surface of the firing tube. The grooves or channels further can be arranged in a spiral or helical pattern at least partially along the interior surface of the firing tube and can cause the aerial shells to spin or rotate as the aerial shells move along the firing tube during launching/firing thereof. The rotation or spin of the aerial shells, for example, can result in higher and/or more controlled flight paths, especially in comparison to aerial shells fired from launcher assemblies having smooth or continuous bores, i.e., launchers without rifling features as provided herein. The launcher assembly further can include a base portion connected to a lower end of the firing tube, e.g., by one or more fasteners. The launching assembly also can include a wadding insert or portion that is press-fitted into the cavity of the firing tube so as to be positioned at or substantially adjacent to the lower end of the firing tube. The wadding insert can at least partially dampen and/or at least partially absorb forces/stresses generated from firing/launching of aerial shells from the firing tube, and can be replaceable/interchangeable to prolong the working life of the firing tube.

In an even further aspect, a process/method for manufacturing and/or assembling the launching assembly can be provided. The method can include obtaining a blank of sheet material (e.g., sheet metal) for forming the firing tube, and forming a plurality of rifling features in a surface of the blank. Upon forming of the plurality of rifling features in the blank, the method can include bending or otherwise forming the blank to at least partially define a cylinder having open or disconnected end or side portions. The method further can include forming one or more flange portions at the ends/sides of the at least partially defined cylinder, and then engaging or connecting the one or more flange portions formed at the ends/sides of the cylinder. For example, the flanges of the ends can be interlaced to join the open/disconnected end/side portions. Thereafter, the one or more flange portions at each end of the cylinder can be pressed together to at least partially form a seam fixedly attaching the open ends of the partially formed cylinder to facilitate the formation of a completed cylinder. In addition, the method can include reinforcing the seam by forming a plurality of corresponding recesses and protuberances therealong. A lip, ring, bulge, or other suitable protruding portion further can be formed along an upper end of the firing tube.

Additionally, upon formation of the firing tube, the firing tube can be received, e.g., press-fitted, into the cavity of the sleeve. A wadding insert further can be received, e.g., press-fitted into, the passage of the firing tube such that the wadding insert is positioned at or substantially adjacent the lower end of the firing tube. The base portion further can be aligned with and then connected to the lower end of the firing tube, for example, using one or more fasteners, e.g., nails, screws, rivets, etc., and/or another suitable attachment mechanism, such as an adhesive, soldering, welding, etc.

Various objects, features and advantages of the present disclosure will become apparent to those skilled in the art upon a review of the following detail description, when taken in conjunction with the accompanying drawings.

BRIEF DESCRIPTION OF THE DRAWINGS

The accompanying drawings, which are included to provide a further understanding of the embodiments of the present disclosure, are incorporated in and constitute a part of this specification, illustrate embodiments of the present disclosure, and together with the detailed description, serve to explain the principles of the embodiments discussed herein. No attempt is made to show structural details of this disclosure in more detail than may be necessary for a fundamental understanding of the exemplary embodiments discussed herein and the various ways in which they may be practiced. According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION

The following description is provided as an enabling teaching of embodiments of this disclosure. Those skilled in the relevant art will recognize that many changes can be made to the embodiments described, while still obtaining the beneficial results. It will also be apparent that some of the desired benefits of the embodiments described can be obtained by selecting some of the features of the embodiments without utilizing other features. Accordingly, those who work in the art will recognize that many modifications and adaptations to the embodiments described are possible and may even be desirable in certain circumstances. Thus, the following description is provided as illustrative of the principles of the embodiments of the present disclosure and not in limitation thereof.

Figure 1:
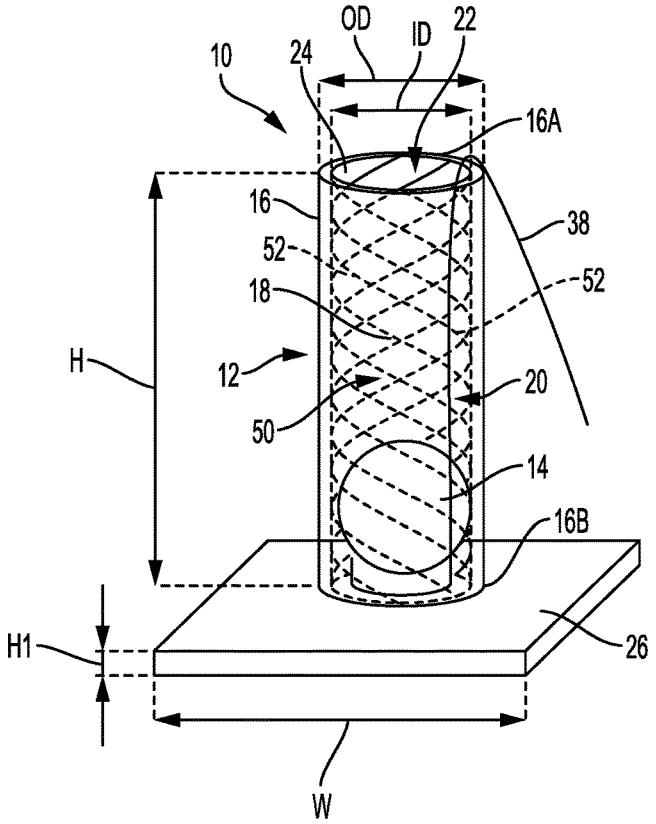
FIG. 1 shows an example embodiment of a pyrotechnic launching system according to principles of the present disclosure.

FIG. 1 shows a pyrotechnic launching system 10 according to principles of the present disclosure. The pyrotechnic launching system 10 comprises a launcher or mortar 12 and one or more aerial shells 14. The aerial shell(s) 14 is configured to be fired or launched from the launcher 12.

As shown in FIG. 1, the launcher 12 includes an elongated body 16. The elongated launcher body 16 has a first or upper end 16A, second or lower end 16B, and a sidewall 18. The launcher body 16 has a generally cylindrical shape, though other shapes are possible without departing from the present disclosure. The launcher body 16 can be formed from any suitable material, with one example being a plastic, such as High Density Polyethylene ("HDPE"), Polyvinyl Chloride ("PVC"), or other suitable plastic or polymeric material. The launcher body 16, however, can be formed of paper, cardboard, other or paper products; metallic products, such as steel, iron, or aluminum; or combinations of the above products and other materials, without departing from the present disclosure. The launcher 12 has a cavity or passage 20 defined at least partially through the launcher body 16. The cavity 20 has an opening 22 at the upper end 16A of the launcher body 16. The aerial shells 14 can be loaded into the launcher body 16 through the opening 22. The cavity 20 at least partially defines, or is substantially adjacent to, an inner or interior surface 24 of the launcher body 16.

While the launcher 12 and system 10 can be dimensioned in any desired size and configuration, one exemplary system 10 and launcher 12 is now described. In this example, the launcher body 16 can have a height H from between about 100 mm to about 400 mm, for example, the height H of the launcher body 16 can be about 265 mm. Also, the exemplary launcher body 16 can have an outer diameter OD from about 35 mm to about 70 mm, and the launcher body 16 can have an inner diameter ID from about 30 mm to about 65 mm. The inner diameter ID typically is sized, dimensioned, or otherwise configured such that the aerial shell(s) 14 can be received within and expelled from the opening 22 of the cavity 20. For example, the inner diameter ID is sized, configured and/or dimensioned to allow a user to insert one or more aerial shells 14 into the opening 22 of the launcher body 16 such that the shells 14 can slide or otherwise move along the cavity 20 to a firing position, for example, at the lower end 16B of the launcher body 16. Further, the inner diameter ID can be sized, configured and/or dimensioned such that at least a portion of the aerial shell 14 is in sliding contact or engagement with the inner surface 24 of the launcher body 16 as the aerial shell 14 moves along the launcher body 16 during launching/firing. In one exemplary embodiment, the launcher body 16 can have an outer diameter OD of about 51 mm and an inner diameter ID of about 47 mm. The launcher body 16 can have any suitable size, dimensions, configuration, or arrangement, however, without departing from the scope of the present disclosure.

FIG. 1 additionally shows the launcher 12 including a base or support portion 26. The base 26 typically is connected to, or formed with, the lower end 16B of the launcher body 16. The base 26 has a square or rectangular shape, though other shapes, such as oval, circular, triangular, polygonal, etc. are possible without departing from the present disclosure. The base 26 can be formed from plastic or other polymeric material, such as High Density Polyethylene ("HDPE"), Polyvinyl Chloride ("PVC"), or other suitable plastic or polymeric material. However, the base 26 may be formed from any suitable material having a density or weight sufficient to at least partially support the launcher body 16 during loading and firing of the aerial shells 14 without departing from the present disclosure. The base 26 typically is formed from the same material as the launcher body 16, but the base 26 and the launcher body 16 can be formed of different materials without departing from the present disclosure. In one exemplary embodiment, the base 26 can have a width W from about 65 mm to about 145 mm, for example, the base 26 can have a width W of about 98 mm. The base 26 can have a thickness or height H1 from about 2.5 mm to about 20 mm, for example, the base 26 can have a thickness or height H1 of about 10 mm. The base 26 can be formed to include any size, dimensions, or configurations suitable to at least partially support, stabilize, and/or maintain the launcher body 16 in a generally vertical or erect arrangement/configuration prior to, during, and/or after firing/launching of the aerial shell 14 from the launcher 12.

Figure 2:
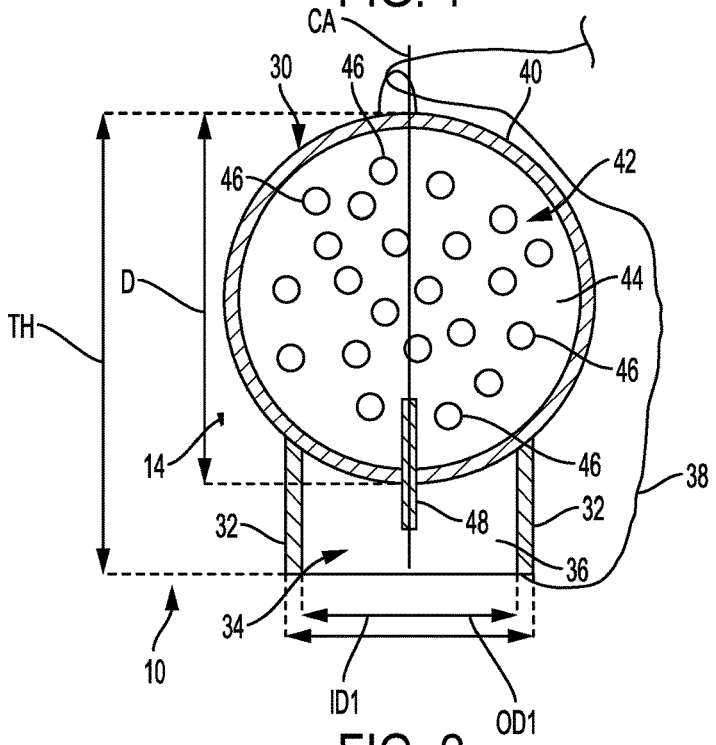
FIG. 2 shows an exemplary aerial shell according to principles of the present disclosure.

FIG. 2 shows an aerial shell 14 according to principles of the present disclosure. The aerial shell 14 includes a lift portion 28 and a show portion 30. As shown in FIG. 2, the lift portion 28 includes a body 32 that has a generally tubular or cylindrical shape, though the body 32 of the lift portion 28 can have any suitable shape without departing from the scope of the present disclosure. For example, the tubular body 32 can have an outer diameter OD1 of about 20 mm to about 35 mm. The tubular body 32 can have an inner diameter ID1 from about 18 mm to about 33 mm. In one embodiment, for example, the tubular body 32 can have an inner diameter of about 24 mm and an outer diameter of about 28 mm. The body 32 of the lift portion 28 can be formed from any suitable material. In one example, the body 32 can be formed from paper-based products, for example, paper, cardboard, other laminate material, or combinations of these materials and/or other materials.

The lift portion 28 also includes a cavity or chamber 34 defined in the body 32 of the lift portion 28. The chamber 34 typically is sized, dimensioned, and/or configured to at least partially house or receive a lift charge or propellant 36 operable to propel the aerial shell 14 from the launcher 12. Activation or ignition of the lift charge 36 generates combustion gases that propel the aerial shell 14 along the launcher body 16 and out of opening 22 in the upper end 16A of the launcher body 16. The lift charge 36 may include Potassium Nitrate ($KNO_3$), Sulfur (S), and/or Carbon (C), though any suitable materials and proportions of materials can be used without departing from the scope of the present disclosure. The aerial shell 14 typically includes an ignition mechanism, for example, a fuse 38, or other suitable detonation mechanism, in communication with the lift charge 36, which fuse 38 can be ignited or otherwise activated to ignite/activate the lift charge 36. The fuse 38 can afford a delay time of about 3 seconds to about 9 seconds, with the delay time being the time from ignition of the fuse 38 to activation of the propellant. The fuse 38 can have any suitable delay time, however, to allow a user to move to a safe distance from the launcher 12 after ignition/activation of the fuse 38. In one embodiment, one or more retainer features, such as a ring or loop, can be provided with the aerial shell 14 to position the fuse 38.

As further shown in FIG. 2, the show portion 30 of the aerial shell 14 can include a body 40 that, for example, has a generally spherical shape, though other shapes are possible without departing from the scope of the present disclosure. The body 40 of the show portion 30 can be connected to, or formed with, the tubular body 32 of the lift portion 28 at a first or upper end 32A of the tubular body 32. The total height TH of the aerial shell 14 can be any desired dimension, for example, the total height TH can be from about 50 mm to about 80 mm. In one embodiment, for example, the total height TH of the aerial shell 14 is about 62 mm. The spherical body 40 of the show portion 30 can have a diameter D from about 25 mm to about 60 mm. In one embodiment, for example, the diameter D of the spherical body 40 is about 44 mm. The show portion 30 can have any desired diameter, size, dimensions, arrangement or configuration without departing from the present disclosure, for example, to allow a user to load or insert one or more area shells 14 into launcher body 16 and/or such that at least a portion of the aerial shell 14 is in sliding contact or engagement with the inner surface 24 of the launcher body 16 as the aerial shell 14 moves along the launcher body 16 during launching/firing thereof. The body 40 of the show portion 30 can be formed, for example, from a paper product or other laminate material, though other materials are possible without departing from the scope of the present disclosure. The show portion 30 further can have a cavity or chamber 42 defined in the body 40 of the show portion 30. The cavity or chamber 42 typically is sized, dimensioned, and/or configured to least partially house or receive a breaking charge 44 and/or one or more effects charges 46.

The breaking charge 44 is operable to at least partially break open the body 40 of the show portion 30 to release the effects charge(s) 46. The effects charge(s) 46 is activated or released to provide one or more effects. The effect(s) may include one or more visual effects having predetermined pattern or arrangement. For example, visual effects may include a specific shape, such as a peony, *chrysanthemum*, a dahlia, willow, palm, ring, diadem, kamuro, crossette, spider, horsetail, time rain, fish, mine, and/or cake patterns or arrangements, though any suitable visual pattern or arrangement can be used without departing from the scope of present disclosure. The visual effect further can include a specific color, for example, red, orange, yellow, green, blue, indigo, violet, white, gray, etc. Any color or combination of colors can be used, however, without departing from the scope of the present disclosure. The effect(s) also may include an audio effect, such as a specific noise signature, for example, a loud bang or a whistling effect. The effects charge 46 can comprise any suitable charge, for example, a charge comprising Potassium Perchlorate ($KClO_4$), Sulfur (S), or Carbon (C), or combinations of these and/or other materials. The breaking charge 44 can comprise any suitable charge, e.g., for example, Potassium Perchlorate ($KClO_4$), Barium Nitrate ($Ba(NO_3)_2$), Sodium Oxalate ($Na_2C_2O_4$), Strontium Carbonate ($SrCO_3$), Magnalium (AL-Mg), Phenolic Resin ($C_{48}H_{42}O_7$), or Shellac ($C_{16}H_{32}O_5$), or combinations of these or other materials.

FIG. 2 additionally shows that the aerial shell 14 includes an internal fuse 48 in communication with the lift and show portions 28/30. The internal fuse 48 is ignited by the lift charge 36 and is configured to ignite or activate the breaking charge 44 and/or the effects charge(s) 46. The internal fuse 48 can be configured to activate the breaking charge 44 or the effects charge(s) 46 when the aerial shell 14 reaches a predetermined height in the flight path of the aerial shell 14. The predetermined height may include a maximum height of the flight path of the aerial shell 14, though the breaking charge 44/effects charge(s) 46 can be activated at any suitable height along the flight path of the aerial shell 14, typically the breaking charge 44/effects charge(s) 46 are extinguished before the breaking charge 44/effects charge(s) 46 reach the ground.

Figure 3:
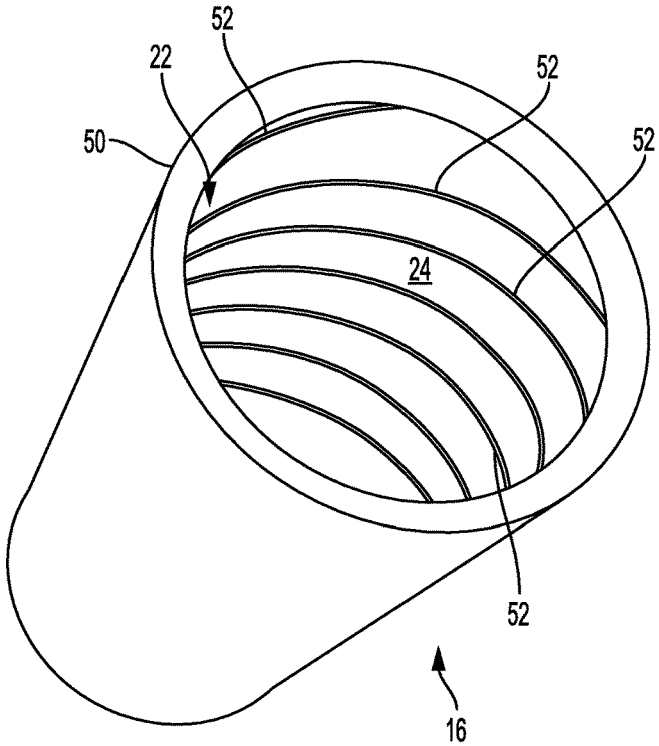
FIG. 3 shows a perspective view of a launcher assembly of the pyrotechnic launching system of FIG. 1.
Figure 4:
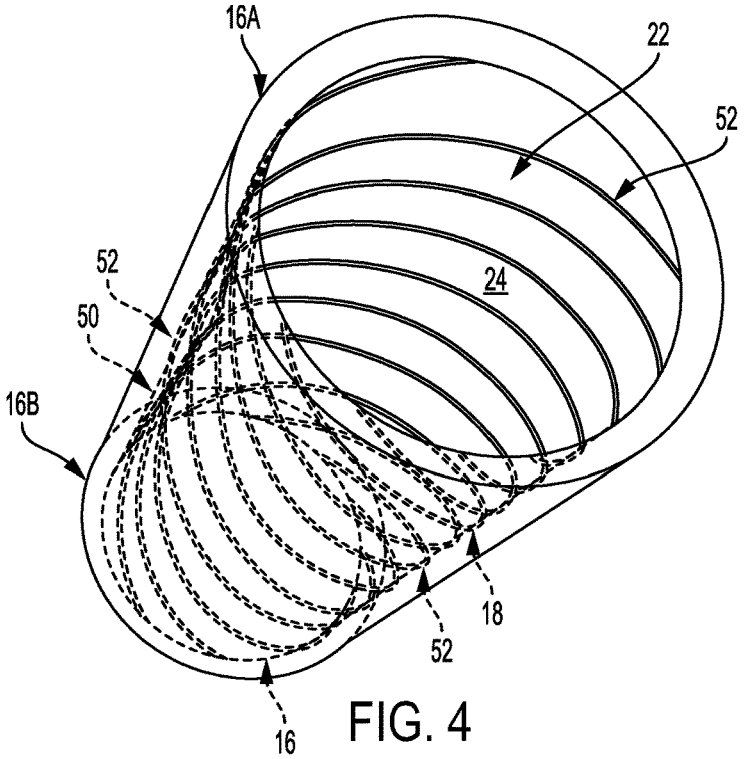
FIG. 4 illustrates a schematic view of the launcher of FIG. 1.

FIG. 3 illustrates a perspective view of the launcher body 16 showing the inner surface 24 of the launcher body 16, and FIG. 4 provides a schematic view of the launcher body 16. As shown in FIGS. 3 and 4, the inner surface 24 comprises rifled portions or rifling features 50 that extend at least partially about/along the inner surface 24 of the launcher body 16. Although other patterns of rifled portions are within the scope of the present disclosure, as shown in FIGS. 3 and 4, the rifled portions 50 typically include one or more grooves or channels 52 defined in the inner surface 24, and that extend at least partially along the inner surface 24 in a pattern. The pattern can include a spiral or helical pattern, configuration, or arrangement. The spiral or helical grooves or channels 52 can be angled or have a twist rate. In one exemplary embodiment, the channels or grooves 52 can extend 360° about the interior surface 24 of the launcher body 16 about every 12 inches (about every 304.8 mm). However, the grooves or channels 52 can have any suitable angle or twist rate, for example, the channels or grooves 52 can extend approximately 360° about the interior surface 24 of the launcher body 16 in a range from about every 6 inches (about every 152.4 mm) to about every 18 inches (about every 457.2 mm), without departing from the present disclosure. Additionally, the grooves or channels 52 can have a depth in the range of about 0.5 mm to about 1.5 mm. In one embodiment, the grooves or channels 52 can have a depth of about 1 mm. The grooves or channels 52 further can have a thickness in the range of about 1 mm to about 3 mm. As shown in FIGS. 3 and 4, the rifled portions 50 can include, for example, eight equally spaced grooves 52 arranged about the interior surface 24 of the launcher body 16. However, any suitable number, arrangement, or configuration of grooves or channels 52, for example, four, five, six, seven, eight, nine, or ten or more grooves/channels may be used without departing from the scope of the present disclosure.

In order to fire the aerial shell(s) 14 from the launcher 12, the aerial shell(s) 14 is typically is inserted into the opening 22 of the launcher body 16. The fuse 38 can be ignited/activated to activate/ignite the propellant/lift charge 36. Activation of the lift charge 36 generates combustion gases that force or propel the aerial shell 14 along the launcher body 16 and out from the opening 22 along a predetermined flight path. As the aerial shell 14 moves along the launcher body 16, the grooves or channels 52 of the rifled portions 50 cause the aerial shell 14 to spin or rotate. For example, the grooves/channels 52 may interact with the combustion gases to cause a swirling effect and generate spin or rotation of the aerial shell 14. Additionally, or in the alternative, at least a portion of the aerial shell 14 may at least partially engage or contact the grooves or channels 52 to generate spin or rotation of the aerial shell 14. The rotation or spin of the aerial shells 14 may be in a direction that is perpendicular or transverse to a central axis CA of the aerial shell 14.

The spinning or rotation of the aerial shell(s) 14 can provide, for example, enhanced control and increase height of the flight path of the aerial shells 14 in comparison to shells fired from a launcher without rifling. By way of example, rotation or spinning of the aerial shells 14 can counteract or substantially prevent the Magnus effect, e.g., the tendency for moving objects to generate backspin or end-to-end tumbling during air-resistant flight. The increased height and/or control of the aerial shells 14 provided by the rifled launcher according to embodiments of the present disclosure can allow the aerial shell 14 to have less (a reduced amount of) propellant in comparison to aerial shells fired from a launcher without rifling. For example, the aerial shells 14 according to the present disclosure can utilize about 5% to about 15% less propellant or lift charge 36 in comparison to aerial shells used with launchers that do not include rifling. The reduction in the percentage of the lift charge 36 can allow more effects charge 46 to be provided to provide more complex patterns or effects. For example, some fireworks, such as fireworks available to ordinary consumers, do not include sufficient amounts of effects charge to allow for complex patterns, e.g., patterns other than spherical shapes, but with the launcher according to principles of the present disclosure, these fireworks can be designed to have complex effects patterns.

Figure 5A:
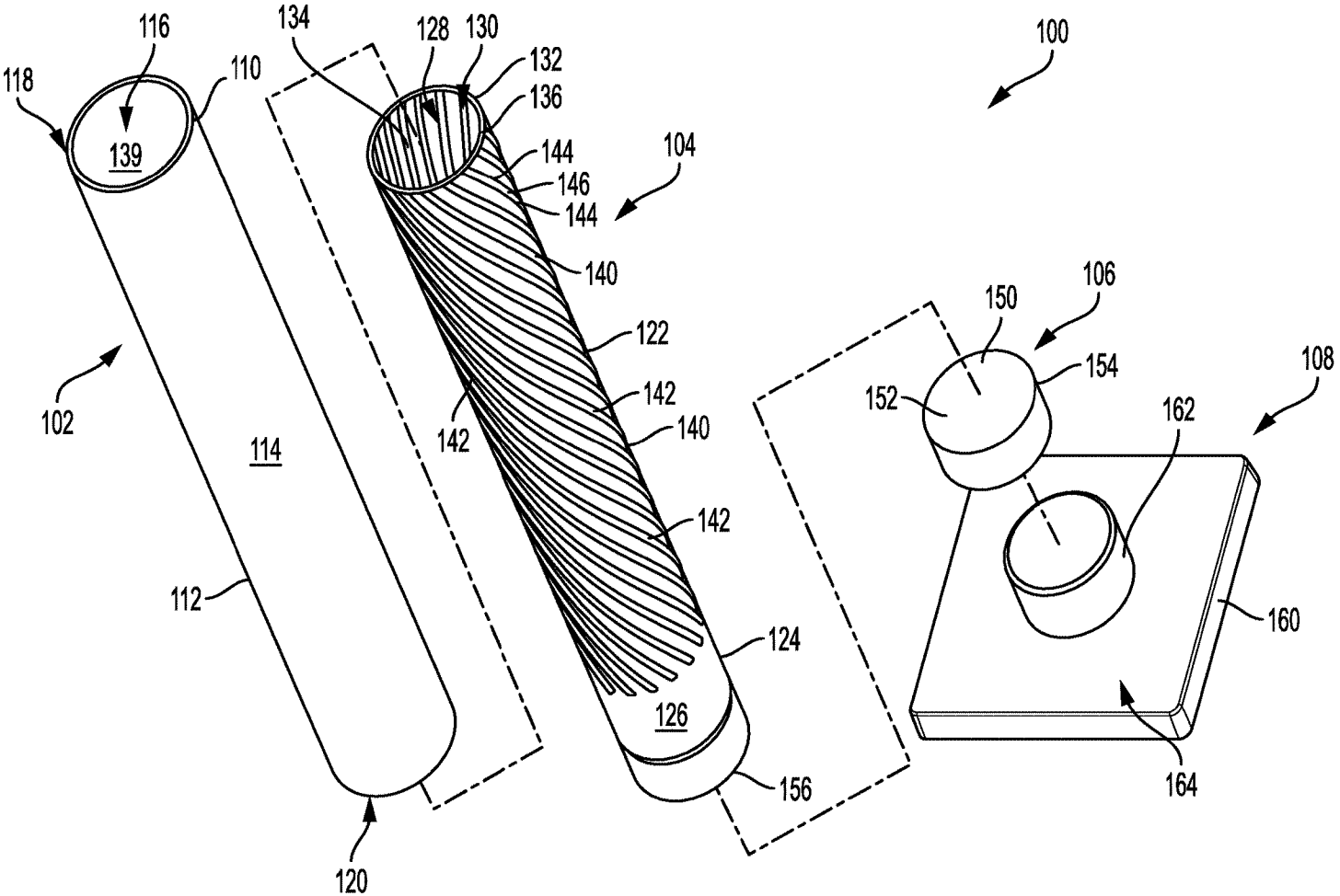
FIGS. 5A and 5B show perspective and exploded views of a launcher assembly according to an additional aspect of the present disclosure.
Figure 5B:
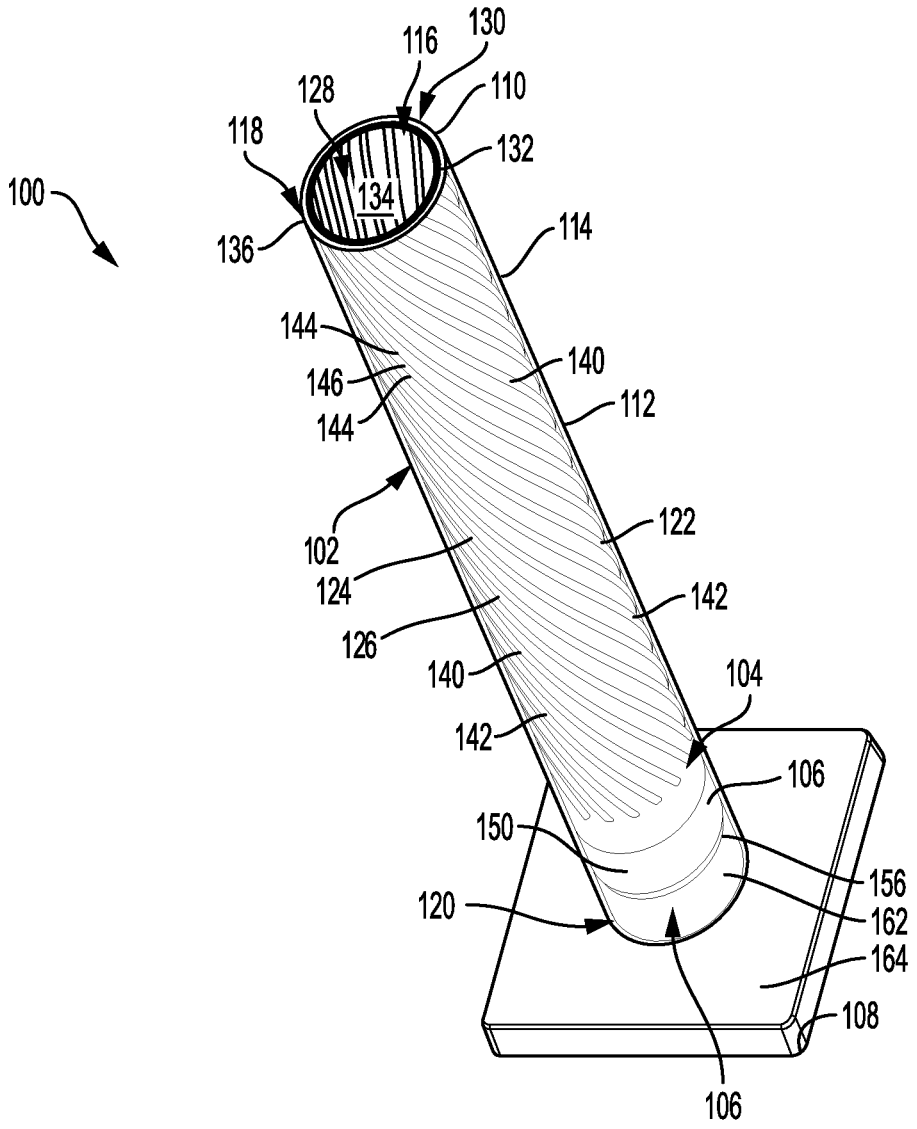

FIGS. 5A and 5B show perspective and exploded views of a launcher assembly 100 according to an additional aspect of the present disclosure. The launcher assembly 100 generally includes an outer portion 102, an inner portion 104, a wadding portion or insert 106, and a base portion 108, and can be used to launch one or more aerial shells 14 (FIG. 2) as described above.

As shown in FIGS. 5A and 5B, the outer portion 102 generally comprises a sleeve or tube 110 that has a body 112 with a sidewall 114 and a cavity or passage 116 defined therethrough. The body 112 of the sleeve 110 comprises upper 118 and lower 120 open ends, and a generally cylindrical or tubular shape, though other shapes, such as tubular shapes having square, rectangular, and/or polygonal cross-sections and/or other suitable shapes or cross-sections can be used without departing from the scope of the present disclosure. In some embodiments, the sleeve 110 can be formed from composite materials, such as paper-based products or plastic materials. For example, in one embodiment, the sleeve 112 can be formed from a hard plastic material, such as High Density Polyethylene ("HDPE"), though other plastics, such as Polyvinyl Chloride ("PVC"), and/or other polymeric materials. In an alternative embodiment, the sleeve 110 can be formed from paper, cardboard, or other paper-based products or laminate materials; however, any other suitable materials or combinations thereof can be employed without departing from the scope of the present disclosure.

In one example embodiment, the sleeve 110 can have a length from about 300 mm to about 400 mm, for example about 310 mm, about 320 mm, about 330 mm, about 340 mm, about 350 mm, about 360 mm, about 370 mm, about 380 mm, about 390 mm, or other integer and non-integer numbers therebetween. The sleeve 110 can have a length less than 300 mm or greater than 400 mm, however, without departing from the scope of the present disclosure. In addition, the sleeve 110 can have an outer diameter of about 50 mm to about 60 mm, such as about 51 mm, about 52 mm, about 53 mm, about 54 mm, about 55 mm, about 56 mm, about 57 mm, about 58 mm, about 59 mm, or other non-integer numbers therebetween, and the sleeve 110 can have an inner diameter of about 45 mm to about 55 mm, such as about 46 mm, about 47 mm, about 48 mm, about 49 mm, about 50 mm, about 51 mm, about 52 mm, about 53 mm, about 54 mm, or other non-integer numbers therebetween. The sidewall 114 of the sleeve 110 further can have a thickness of about 1 mm to about 3 mm, such as about 2 mm or other non-integer numbers therebetween. In an exemplary embodiment, the sidewall 114 of the sleeve 110 can have a thickness of about 2.25 mm. The cavity 116 of the sleeve 110 further can be sized, dimensioned, or otherwise configured to at least partially receive the inner portion 104. It should be understood that the sleeve 110 can have any suitable size, dimensions, and/or configurations, without departing from the scope of the present disclosure.

As additionally shown in FIGS. 5A and 5B, the inner portion 104 can include a firing tube 122. The firing tube 122 comprises a body 124 with an outer sidewall 126 and a passage or cavity 128 defined therethrough. The passage 128 can be sized, dimensioned, or otherwise configured to receive one or more aerial shells 14 for firing from the launcher assembly 100. For example, the aerial shell(s) 14 can be received/loaded into the passage 128 at an opening 130 along an upper end 132 of the firing tube 122. The firing tube 122 further can include an interior surface 134 opposite the outer sidewall 126, and the aerial shells 14 may at least partially engage, e.g., be in slidable contact with, the interior surface 134 during launching thereof. In one embodiment, the firing tube 122 can be formed from a metallic material, such as tin or aluminum, though other metals, e.g., steel, and/or other suitable materials, e.g., high strength plastics or other composite materials, can be used without departing from the scope of the present disclosure.

FIGS. 5A and 5B further show that the firing tube 122 also can have a lip, bulge, or ring portion 136 defined at the upper end 132 thereof. In addition, or in the alternative, one or more lip, bulge, or ring portions can be formed along a lower end 156, or other intermediate portion, of the firing tube 122. The lip 136 can extend circumferentially about the sidewall 126 of the firing tube 122. The lip 136 further can at least partially engage the interior surface 139 of the sleeve 110 of the outer portion 102, for example, in frictional contact therewith, to facilitate attachment and/or to help to secure firing tube 122 within the cavity 116 of the sleeve 112. The lip 136 can also substantially reinforce, for example, increase the strength or stress capacity along, the upper end 132 of the firing tube 122. By way of example, it will be understood that, during or after firing of the aerial shell(s) 14 in the firing tube 122, a maximum pressure may be experienced along the upper end 132 of the firing tube 122 and the lip 136 may help to prevent or minimize damage thereto during firing, and repeated firing, of the aerial shell(s) 14.

The firing tube 122 also can include a plurality of rifling features 140 defined in and extending at least partially along the interior surface 134 of the firing tube 122, as generally shown in FIGS. 5A and 5B. For example, the rifling features 140 include one or more grooves or channels 142 defined in the interior surface 134 of the firing tube 122 and arranged in a prescribed pattern or configuration, e.g., a spiral or helical pattern, along the firing tube 122, although other patterns of rifling are within the scope of the present disclosure. The channels 142 generally comprise a square or rectangular shape that is recessed to a prescribed depth with respect to the interior surface 134, though other shapes, e.g., circular, triangular, or polygonal shapes, etc., can be employed without departing from the scope of the present disclosure. As described herein, the rifling features 140 can be formed through the sidewall 126 of the firing tube 122 such that complementary surface features are formed on the interior surface 134 of the firing tube 122 and the outer surface of the sidewall 126. In one embodiment, the complementary surface features on the outer surface of the sidewall 126 can at least partially engage, e.g., grip or frictionally engage, the interior surface 139 of the sleeve 110 to maintain a secure coupling of the sleeve 110 and the firing tube 122 upon assembly thereof. However, any suitable retaining features can be arranged along the outer surface of the sidewall 126 to facilitate a secure coupling of the sleeve 110 and the firing tube 122, without departing from the scope of the present disclosure.

As the aerial shell(s) 14 moves along the firing tube 122 after ignition thereof, the grooves or channels 142 of the rifling features 140 can cause the aerial shell(s) 14 to spin or rotate. For example, the grooves/channels 142 may interact with the combustion gases to cause a swirling effect and generate spin or rotation of the aerial shell(s) 14. Additionally, or in the alternative, at least a portion of the aerial shell 14 may at least partially engage or contact the grooves or channels 142 to generate spin or rotation of the aerial shell 14. The rotation or spin of the aerial shells 14 may be in a direction that is perpendicular or transverse to a central axis CA of the aerial shell 14. The spinning or rotation of the aerial shell(s) 14 can provide, for example, enhanced control and increase height of the flight path of the aerial shells in comparison to shells fired from a launcher without rifling. The increased height and/or control of the aerial shells 14 provided by the rifled launcher assembly 100 according to embodiments of the present disclosure can allow the aerial shell 14 to have less (a reduced amount of) propellant in comparison to aerial shells fired from a launcher without rifling. For example, the aerial shells 14 according to the present disclosure can utilize about 5% to about 15% less propellant or lift charge 36 in comparison to aerial shells used with launchers that do not include rifling features. The reduction in the percentage of the lift charge 36 can allow the aerial charge 14 to include more effects charge 46 to allow for more complex patterns or effects. For example, some fireworks, such as fireworks available to ordinary consumers, do not include sufficient amounts of effects charge to allow for complex patterns, e.g., patterns other than spherical shapes, but with the launcher assembly 100 according to principles of the present disclosure, these fireworks can be designed to have complex effects patterns.

In one embodiment, the channels 142 can include a pair of opposing side walls or portions 144 with an intermediate wall or portion 146 extending therebetween (FIGS. 5A and 5B). The side walls 144 generally are positioned perpendicular with respect to the intermediate wall 146, though the sidewalls 144 can be angled with respect to the intermediate wall/portion 146 without departing from the scope of present disclosure. In one example, the side walls 144 can have a length, i.e., the channel 142 can have a depth, of about 0.5 mm to about 5.0 mm, for example, about 1 mm, about 2 mm, about 3 mm, about 4 mm, or other non-integer numbers therebetween, though the sidewalls 144 can have a length (i.e., the channel 142 can have a depth) of less than 0.5 mm or greater than 5.0 mm without departing from the scope of the present disclosure. In addition, the intermediate wall 146 can have a length, i.e., the channels can have a width, of about 0.5 mm to about 5.0 mm, for example, about 1 mm, about 2 mm, about 3 mm, about 4 mm or other non-integer numbers therebetween, though the intermediate wall 146 can have a length (i.e., the channel can have a width) of less than 0.5 mm or greater than 5.0 mm without departing from the scope of the present disclosure. Although each of the channels 142 in FIGS. 5A and 5B are generally shown to have the same, or substantially similar, size or configuration, various channels can have different or varying sizes, dimensions, and/or configurations along the firing tube 122 without departing from the scope of the present disclosure.

The channels 142 further can be angled or have a twist rate so as to extend approximately 360° about the interior surface 134 of the firing tube 122 in a range from about every 50 mm to about every 500 mm, or other integer and non-integer numbers therebetween. Although the channels 142 can have any suitable twist rates, such as twist rates in which the channels 142 extend approximately 360° about the interior surface 134 of the firing tube 122 at a distance less than every 50 mm or at a distance greater than every 500 mm, without departing from the scope of the present disclosure. The rifling features 140 can include, for example, 10 or more equally spaced channels 142 arranged about the interior surface 134 of the firing tube 122. However, any suitable number, arrangement, or configuration of channels 142, for example, 10 or less, 11, 12, 13, 14, 15, 16, 17, 18, 19, or 20 or more channels 142 may be used without departing from the scope of the present disclosure. The channels 142 further can be spaced apart at a distance from about 0.5 mm to about 10 mm, for example, about 1 mm, about 2 mm, about 3 mm, about 4 mm, about 5 mm, about 6 mm, about 7 mm, about 8 mm, about 9 mm, or other non-integer numbers therebetween. The channels 142 can be spaced apart at any suitable distance, however, such as less than 0.5 mm or greater than 10 mm without departing from the scope of the present disclosure.

As further shown in FIGS. 5A and 5B, the launcher assembly 100 can include a wadding portion or insert 106. The wadding portion 106 can include a body 150 having a substantially cylindrical shape, or other suitable shape or configuration, that can be at least partially received within the passage 128 of the firing tube 122. The body 150 of the wadding portion 106 can be formed from cork or other suitable material. The body 150 of the wadding portion 106 further can have a diameter of about 45 mm to about 55 mm, such as about 46 mm, about 47 mm, about 48 mm, about 49 mm, about 50 mm, about, 51 mm, about 52 mm, about 53 mm, about 54 mm, or other non-integer numbers therebetween, or any another suitable diameter that allows the wadding portion 106 to be at least partially received within the passage 128 of the firing tube 122. The body 150 further can have a thickness or height of about 15 mm to about 25 mm, such as about 16 mm, about 17 mm, about 18 mm, about 19 mm, about 20 mm, about 21 mm, about 22 mm, about 23 mm, or about 24 mm, though the height/width can include any suitable value such as less than 15 mm or greater than 25 mm, without departing from the present disclosure.

FIG. 5B additionally shows that the wadding portion 106 can be at least partially received within the passage 128 of the firing tube 122 at or substantially adjacent to a lower end 156 of the firing tube 122. In one embodiment, the firing tube 122 further can have one or more projecting portions and/or other retaining features to at least partially engage the wadding portion 106 to substantially hold the wadding portion 106 in its position at the lower end 156 of the firing tube 122. The wadding portion 106 further has a surface or face 152 at an upper end 154 thereof, which surface/face 152 can at least partially support aerial shells 14 received/loaded into the firing tube 122. As a result, the wadding portion 106 may at least partially dampen and/or absorb stresses, pressure, or other forces generated from combustion gases resulting from ignition of the aerial shells 14. The wadding portion 106 further may be replaceable/interchangeable to prolong the working life of the firing tube 122, e.g., to prevent or reduce damage to, or wear of, the firing tube 122 due to firing, and repeated firing, of aerial shells 14 therefrom.

FIGS. 5A and 5B also show that the launcher assembly 100 further can include a base or support portion 108. The base 108 can have a body 160 with square or rectangular shape, though other shapes, such as triangular, circular, polygonal shapes, etc. are possible without departing from the present disclosure. The base 108 further can be formed from hard plastics or other polymeric materials, such as High Density Polyethylene ("HDPE"), Polyvinyl Chloride ("PVC"), etc., though any suitable material, such as metallic materials, paper-based products, or other composite materials can be employed without departing from the scope of the present disclosure. The base 108 further can have a width or diameter of about 1,000 mm to about 1,400 mm, such as about 1,100 mm, about 1,200 mm, about 1,300 mm, or other integer or non-integer numbers therebetween. For example, in an exemplary embodiment, the base 108 can have a width of about 1,255 mm. The base 108 can include any suitable width, such as widths less than 1,000 mm and greater than 1,400 mm, or other suitable dimensions, configurations, and/or constructions, so long as the base is generally configured to maintain the launcher assembly 100 in a generally erect/upright orientation before, during, and after firing of the aerial shell(s) 14 therefrom, without departing from the present disclosure.

Figure 13:
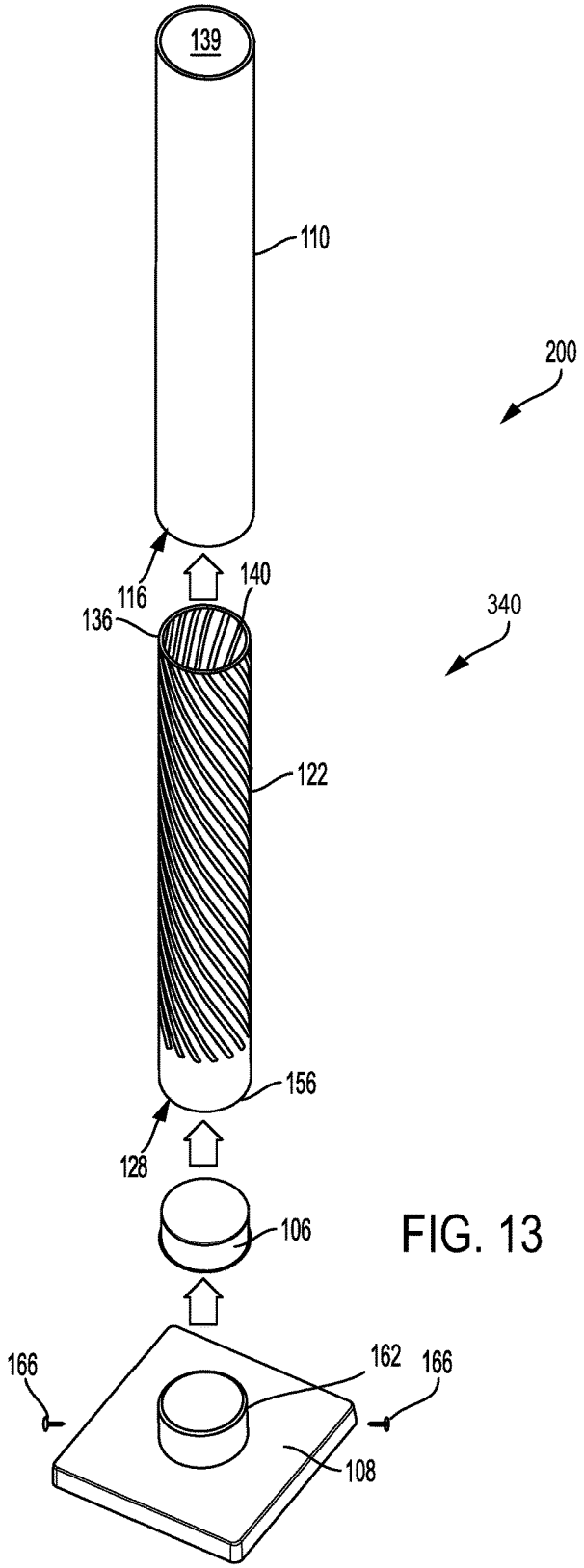
FIG. 13 shows a schematic illustration of a process step for assembling the launcher assembly upon formation of the firing tube according to one aspect of the present disclosure.

The base 108 additionally has a projecting portion or other extending portion 162 defined along an upper surface 164 thereof. The projecting portion 162 can have a generally cylindrical shape that is configured to be at least partially received along or at least partially within the interior passage 134 of the firing tube 122, e.g., at its lower end 156, to facilitate connection of the base portion 108 to the firing tube 122. In one example embodiment, the projecting portion 162 can have a diameter of about 45 mm to about 55 mm, such as about 46 mm, about 47 mm, about 48 mm, about 49 mm, about 50 mm, about 51 mm, about 52 mm, about 53 mm, about 54 mm, or other non-integer numbers therebetween, or another suitable diameter that allows the projecting portion to be at least partially received within or aligned along the firing tube 122. In addition, in one embodiment, the projecting portion 162 can be fixedly connected to the firing tube 122, for example, using one or more fasteners 166 such as nails, rivets, screws etc. (FIG. 13). Any suitable fixing mechanism, such as an adhesive, soldering, welding, etc., however, may be employed to connect the base 108 and the firing tube 122, without departing from the scope of the present disclosure.

Figure 6:
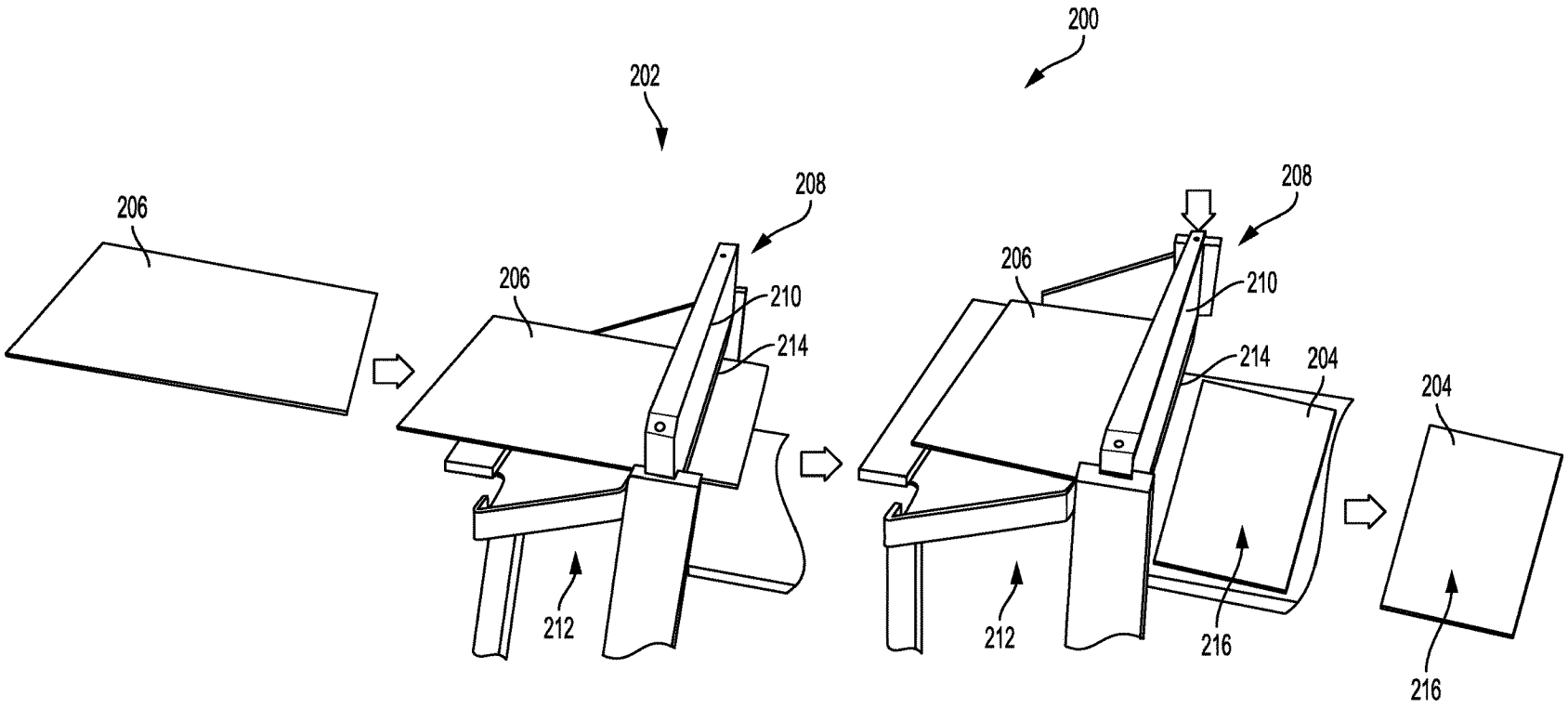
FIG. 6 shows a schematic illustration of a process step of forming a blank for a firing tube according to principles of the present disclosure.

FIGS. 6-13 show an exemplary method/process 200 for manufacturing and/or assembling the launcher assembly 100 according to one aspect of the present disclosure. FIG. 6 shows a schematic view of a step 202 of forming a blank 204 for the firing tube 122 from a supply of material 206, e.g., a supply of sheet metal, such as tin, aluminum, stainless steel, etc. For example, as shown in FIG. 6, a supply of sheet metal 206 can be at least partially fed into/received in a cutting machine 208, such as a manually operated or hydraulic shear machine, to at least partially cut the supply of sheet metal 206 into a blank(s) 204 for forming the firing tube 122. The cutting machine 208 can have a head 210 and a base portion 212. The head 210 can have a cutting blade or other sharpened portion 214 attached thereto/arranged therealong, which cutting blade 214 can be brought into engagement with the supply of sheet metal 206 to cut a portion, e.g., a blank 204, therefrom. The blank(s) 204 can be formed in any suitable manner, however, for example, by punching out the blank(s) 204 from the supply of sheet metal, or cast molding methods, etc., without departing from the scope of the present disclosure. Upon forming/obtaining the blank 204, the rifling features 140 can be at least partially formed in and along a surface/face 216 of the blank 204.

Figure 7:
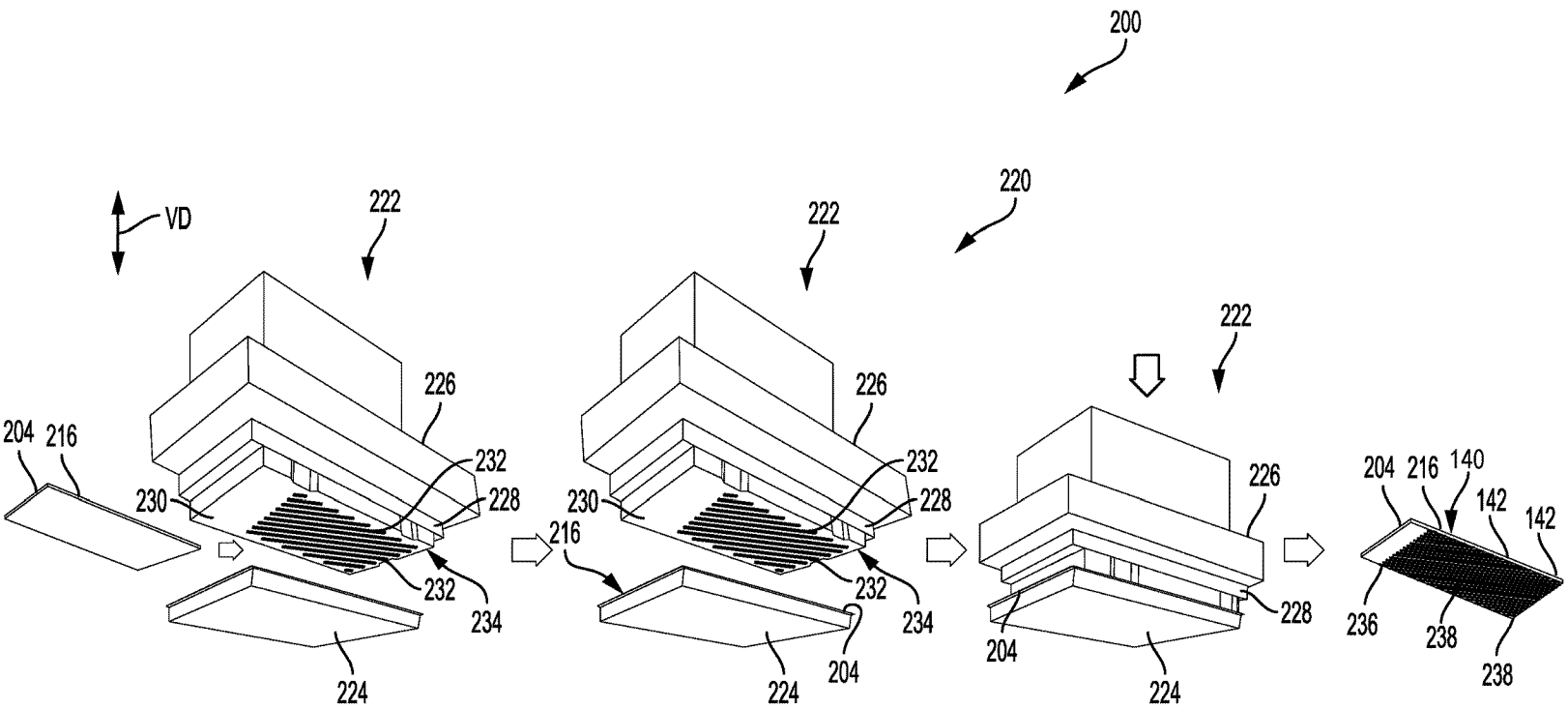
FIG. 7 shows a schematic illustration of a process step for forming the rifling features or rifled portions in the blank of FIG. 6 according to one aspect of the present disclosure.

FIG. 7 shows a schematic view of a step 220 forming the rifling features 140 in the blank(s) 204. As shown in FIG. 7, in one embodiment, the blank(s) 204 can be loaded into a machine press or other suitable machine 222 having a base portion 224 and a head portion 226. The head portion 226 can be moveable, for example, along the vertical direction (shown as VD in FIG. 7), for bringing or pressing a die portion 228 connected to the head portion 226 into engagement or contact with the surface/face 216 of the blank 204. FIG. 7 further illustrates that the die portion 228 can have a generally flat surface 230 with a plurality of protruding portions 232 formed therealong for forming the rifling features 140 in and along the surface/face 216 of the blank 204. In one embodiment, the protruding portions 232 can have, for example, a generally rectangular or square cross-section shape, or other suitable cross-section or shape, e.g., round, arcuate, triangular, polygonal, etc., to facilitate the formation of corresponding channels 142, for example, having a generally rectangular or square cross-section or other suitable cross-section or shape, into the surface 216 of the blank 204. Additionally, the protruding portions 232 can be angled along the surface 230 of the die portion 228. For example, the protruding portions 232 can be angled from about 20° to about 70°, such as, for example, about 25°, about 30°, about 35°, about 40°, about 45°, about 50°, about 55°, about 60°, about 65° or other integer or non-integer numbers therebetween, or combinations thereof, with respect to an end 234 of the die portion 228. The protruding portions 232 can be disposed at suitable angle with respect to end 234 of the die portion 228, however, such as less than 20° or greater than 70°, without departing from the scope of the present disclosure. As a result, after the die portion 228 has been at least partially pressed into engagement with the surface 216 of the blank 204 by movement of the head 226 upon activation of the machine press 222, the surface 216 will have a plurality of channels 142 defined therealong to form the rifling features 140 along the firing tube 122, and further, an opposing surface/face 236 of the blank 204 will have a plurality of corresponding projecting portions 238, e.g., generally having rectangular or square cross-section, defined therealong. Although a machine press 222 is employed in step 220, as shown in FIG. 7, to form the rifling features 140 into the blank(s) 204, any suitable machine, mechanism, tool, process, etc. can be used to form the rifling features 140 in the blank(s) 204. For example, the blank(s) can be fed through a press rolling machine with a roller having a plurality of projection portions defined therealong, or alternatively, cast molding or other suitable process can be employed for forming the rifling features in the blank without departing from the scope of the present disclosure.

In some embodiments, a protective layer can be applied to one or more of the surfaces 216 or 236 of the blank 204 after formation of the rifling features 140 therein. For example, the protective layer can include a protective coating, for example a PTFE (polytetrafluoroethylene) coating such as Teflon™ (available from The Chemours Company of Wilmington, Del.), or other suitable protective coating, at least partially applied to the surface/face 216 and the channels 142 defined therein to prevent or reduce wear or damage, for example, due to firing and/or repeated firing of aerial shells 14 from the firing tube 122.

Figure 8:
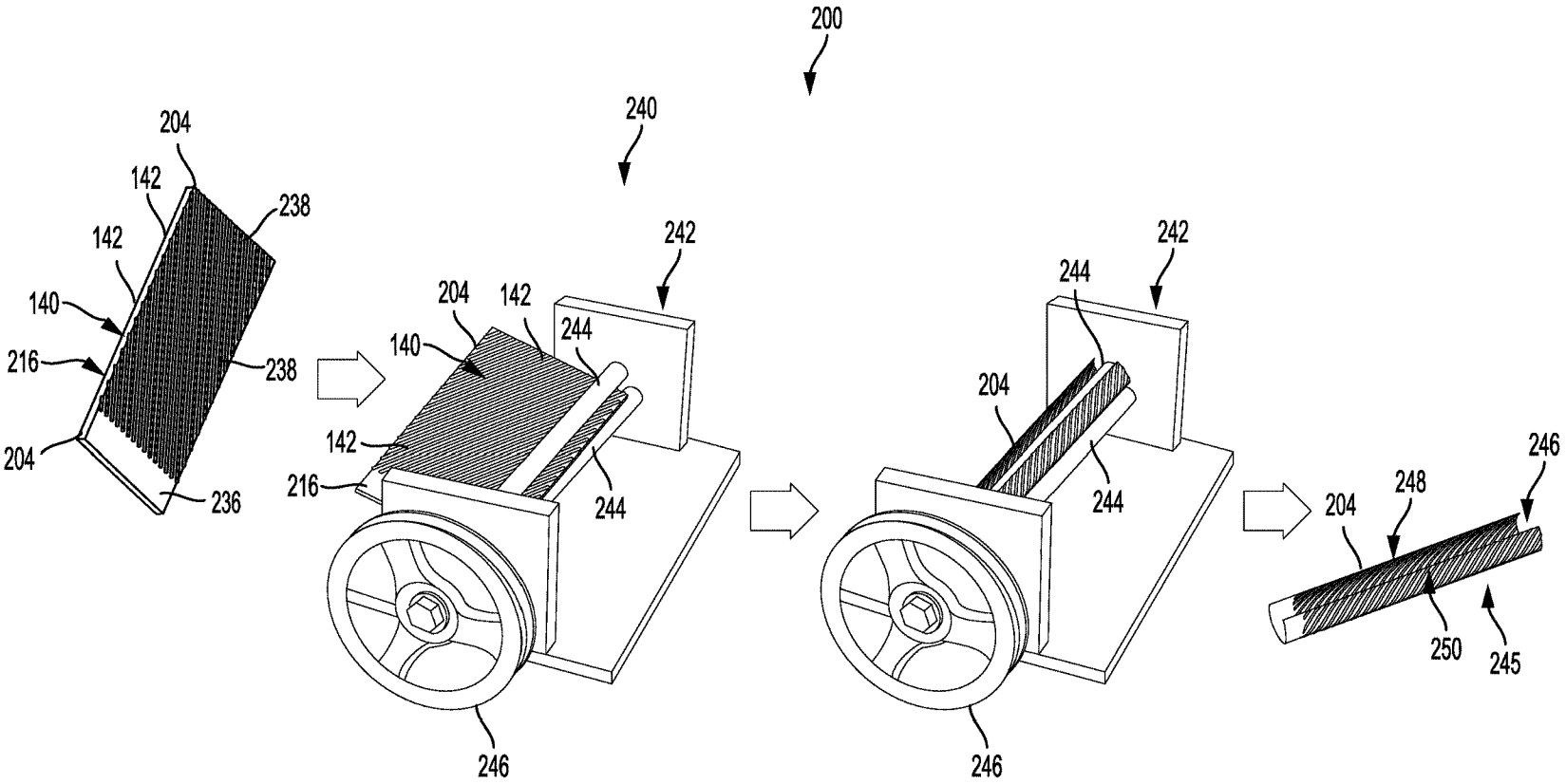
FIG. 8 shows a schematic illustration of a process step for bending or otherwise forming the blank of FIG. 7 to define an at least partial cylinder according to one aspect of the present disclosure.

FIG. 8 provides a schematic illustration of a step 240 for forming, e.g., bending, the blank 204 to have a generally cylindrical shape. As shown in FIG. 8, the generally flat blank 204, with the rifling features 140 defined therein, can be at least partially received within a roller apparatus/mechanism 242. In one embodiment, the roller apparatus/mechanism 242 can include a roll forming machine or slip roll machine or any other suitable machine having a plurality of tubular or cylindrical portions 244 that can at least partially engage the blank 204 to bend or deform the blank 204 to have a generally cylindrical or tubular shape. For example, the plurality of tubular or cylindrical portions 244 can be rotated, e.g., by actuating a wheel or lever 246 of the roller apparatus/mechanism 242, to engage or contact the blank 204 and bend or deform the blank 204 such that the blank 204 will define an at least partially formed cylinder 245 with discontinuous portion 246 therealong, e.g., with opposing sides/ends 248/250 of the blank 204 spaced apart and disconnected. Although FIG. 8 shows a manually activated roll machine 242, a hydraulic roll machine or other suitable apparatus can be used to form/bend the blank(s) 204 to have a generally cylindrical shape without departing from the scope of the present disclosure.

Figure 9:
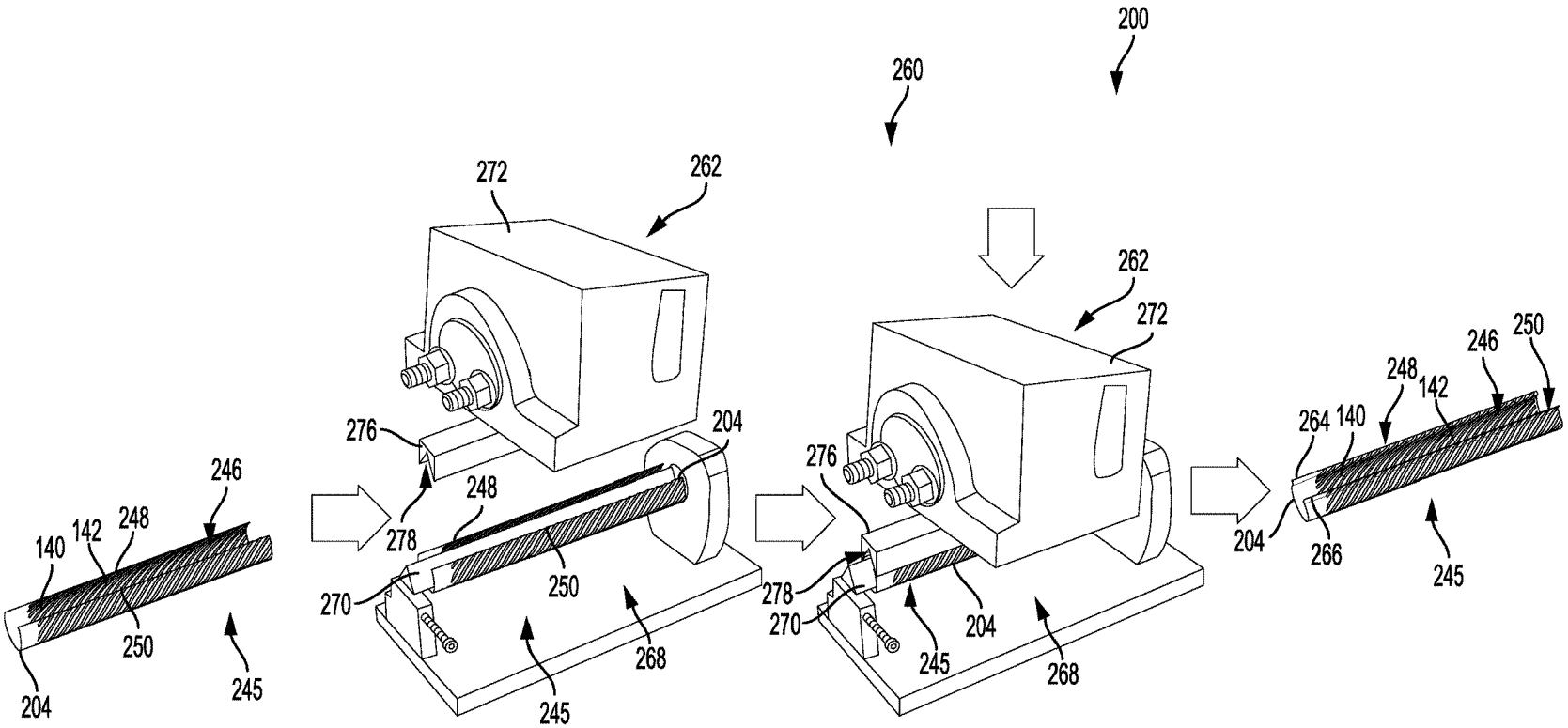
FIG. 9 provides a schematic illustration of a process step for forming one or more flanges on the blank of FIG. 8 according to one aspect of the present disclosure.
Figure 10:
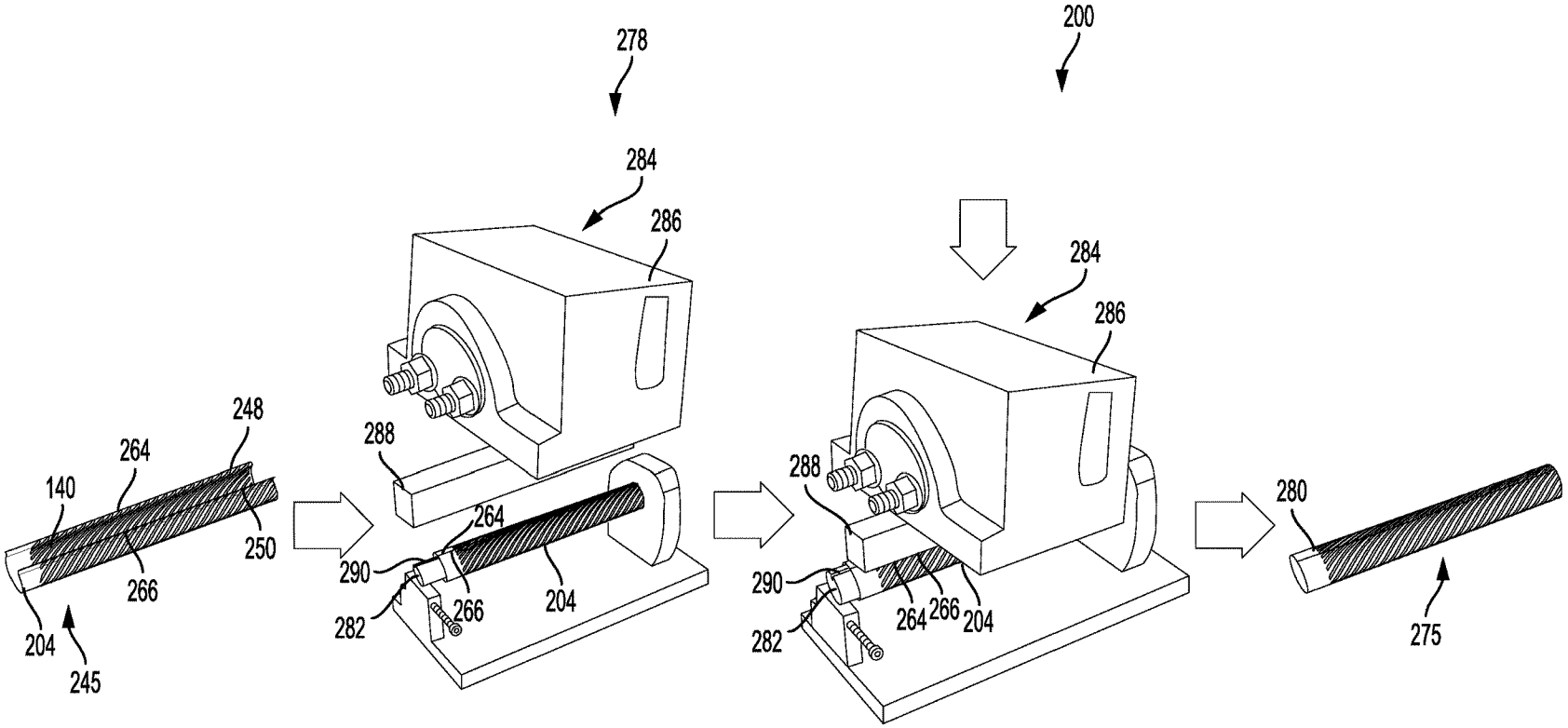
FIG. 10 provides a schematic illustration of a process step for generating a seam to form the blank of FIG. 9 into a completed cylinder according to one aspect of the present disclosure.

FIG. 9 provides a schematic illustration of a step 260 for forming one or more flanges 264/266 onto end/sides 248/250 of the blank 204. As shown in FIG. 9, the disconnected ends/sides 248/250 of the at least partially formed cylinder 245 can be fed or received in a machine press 262 to bend or deform the ends/sides 248/250 to include one or more flanges 264/266 or other suitable portions. The machine press 262 may have a base portion 268 that has one or more angled or sloped surfaces or portions 270 and a movable head 272 with a die portion 276 attached thereto, which die portion 276 has a groove or notch 278 defined therealong to at least partially receive the angled or sloped portions 270 of the base portion 268. Accordingly, at least a portion of the disconnected ends 248/250 of the cylinder 245 can be placed on or otherwise positioned along the one sloped/angled surfaces 270, and the head 272 can be moved to bring the die portion 276 into contact or engagement with the disconnected ends 248/250 to bend or deform at least a portion of the disconnected ends 248/250 to form one or more flanges 264/266 therealong. The one or more flanges 264/266 formed along the disconnected ends 248/250 can be interlocked, intermeshed, or otherwise engaged together to facilitate the formation of a completed cylinder 275 (FIG. 10). Any suitable mechanism, machine, process, etc. can be employed to form the flanges, however, without departing from the scope of the present disclosure.

FIG. 10 provides a schematic illustration of a step 278 of generating a seam 280 to form the partially formed cylinder 245 into a completed cylinder 275. As shown in FIG. 10, the one or more flanges 232 along the disconnected ends 248/250 of the partially formed cylinder 245 can be interlocked or otherwise brought into engagement with each other to join the disconnected ends 248/250. The interlocked flanges 264/266 then can be at least partially received along a mandrel 282 or other suitable cylindrical portion within a machine press 284 having a movable head 286 with a die portion 288 attached thereto. In one embodiment, the interlocked flanges 264/266 can be arranged in at least partial alignment with a groove or notch 290 (FIG. 10), or alternatively a projecting portion (not shown), defined along the mandrel 282. The head 286 of the machine press 284 then can be moved to bring the die portion 288 into engagement with the interlock flanges 264/266 to press the interlocked flanges 264/266 together and generate the seam 280 to form the completed cylinder 275. The seam 280 can include a plurality of layers pressed together, with at least one layer from end 248 and at least one layer from end 250 sandwiched between the outer and interior surfaces of the completed cylinder 275.

Figure 11:
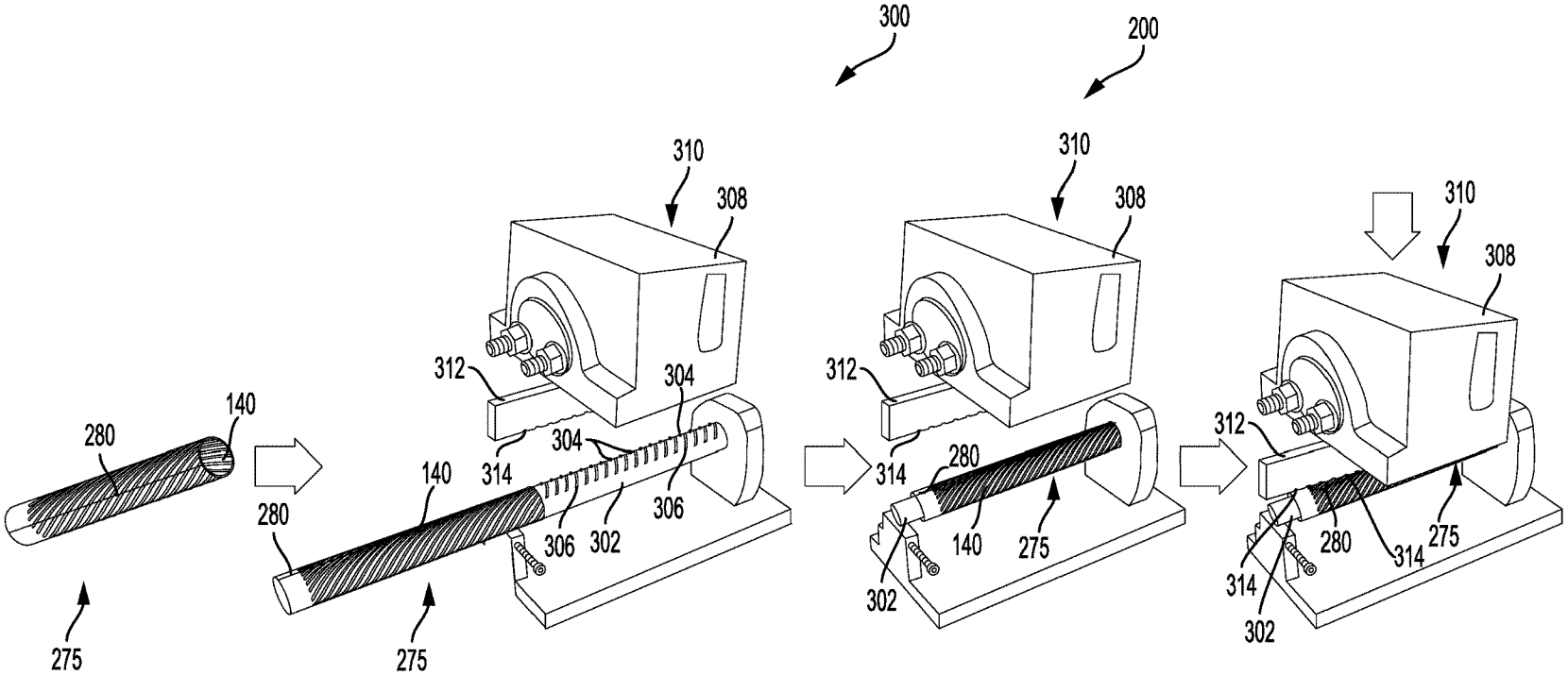
FIG. 11 provides a schematic illustration of a process step for reinforcing the seam along the completed cylinder according to one aspect of the present disclosure.

FIG. 11 provides a schematic illustration of a step 300 for reinforcing the seam 280 formed along the completed cylinder 275. As shown in FIG. 11, the completed cylinder 275 can be placed or otherwise received along a mandrel 302 or other suitable portion having a series of protuberances or projections 304 formed therealong. For example, the completed cylinder 275 can be positioned about the mandrel 302 such that the protuberances or projections 304 are at least partially aligned along the seam 280. The mandrel 302 further can have projection portions 306 arranged therealong that are sized to be at least partially received within the rifling features 140 defined along the firing tube 122, for example, to facilitate alignment of the seam 280 therealong, as well to prevent damage to the rifling features 140 during reinforcement of the seam 280. Accordingly, when a head 308 of the machine press 310, in which the mandrel 302 is loaded into, is moved to bring a die portion 312 attached to the head portion 308 into engagement with the seam 280, the plurality of protuberances or projections 304 at least partially engage the seam 280 to form a plurality of interlocking indentations/dimples and projections/protuberances therealong. The die portion 312 connected to the head 308 of the machine press 310 further can have grooves or notches 314 defined therealong that correspond to the rifling features 140 to prevent damage thereto when the die portion 312 is pressed against the seam 280 for reinforcement thereof. By way of example, when the die portion 312 is pressed or engaged against the seam 280, corresponding indentations and projections can be formed in each of the layers of the seam 280 to facilitate locking therebetween, e.g., a projection of at least one layer of the seam 280 can be received within a corresponding indention of at least one adjacent layer of the seam 280 to prevent separation thereof. Accordingly, the firing tube 122, and the seam 280 formed therealong, is able to withstand pressure/stresses developed during firing (and repeated firing) of one or more aerial shells 14 from the firing tube 122.

Figure 12:
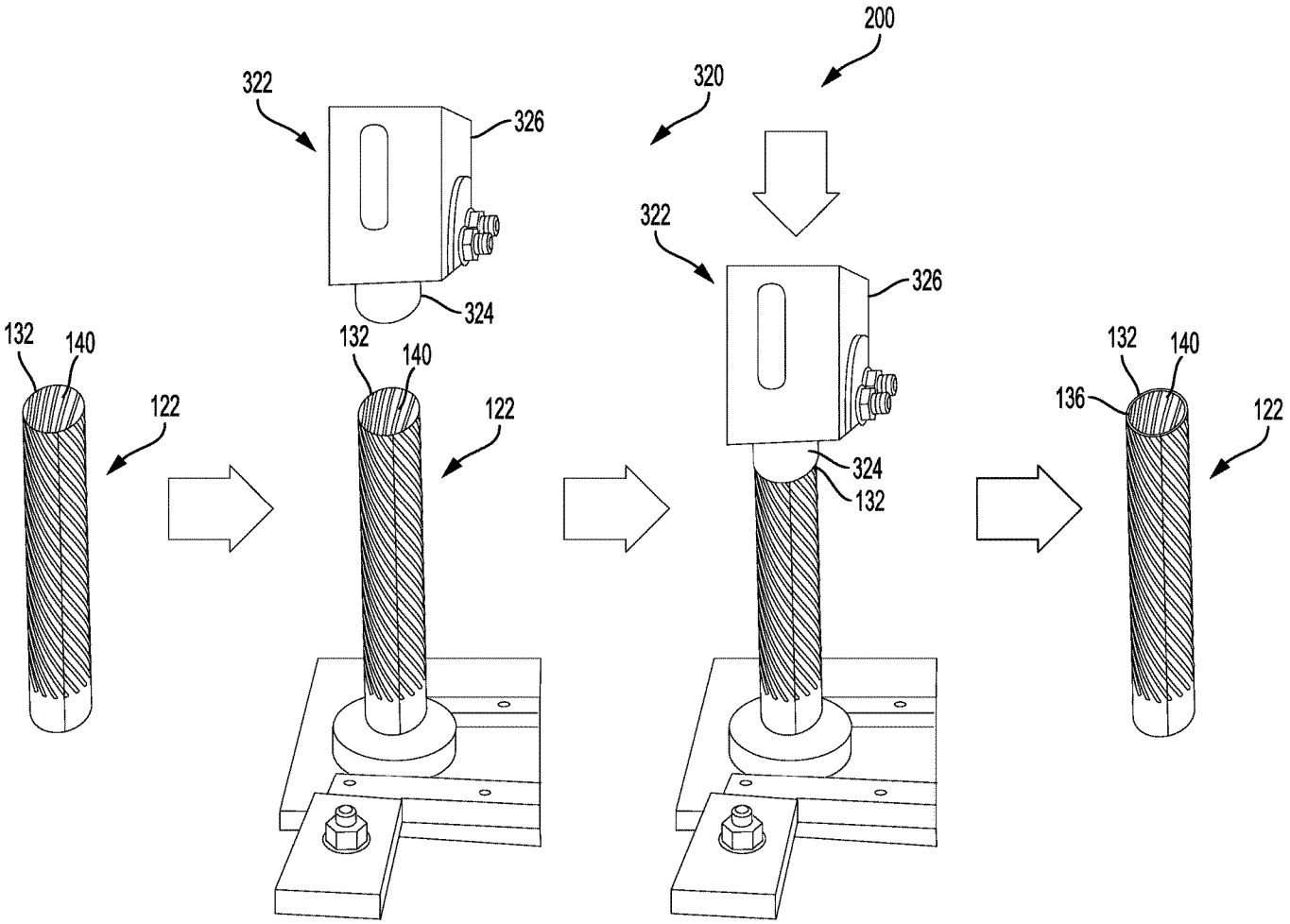
FIG. 12 provides a schematic illustration of a process step for forming a lip or ring portion about the upper end of the firing tube according to one aspect of the present disclosure.

FIG. 12 provides a schematic illustration of a step 320 for forming a lip, bulge, or ring portion 136 about the upper end 132 of the firing tube 122. As shown in FIG. 12, the firing tube 122 can be at least partially loaded or received within a machine press 322. Then, a die portion 324 attached to a head 326 of the machine press 322 can be brought into contact or engagement with the upper end 132 of the firing tube 122 to at least partially fold over a portion of the upper end 132 of the firing tube 122 to form a lip, bulge, or ring portion 136 therealong. The lip/ring 136 can substantially reinforce the upper end 132 of the firing tube 122, where the pressure is the highest during launching of aerial shells 14, and thereby prevent, reduce, or minimize damage to the firing tube 122 upon firing and/or repeated firing of one or more aerial shells 14 therefrom. In addition, the lip/ring 136 further can facilitate connection between the sleeve 110, and the firing tube 122. For example, with the sleeve 110 received about the firing tube 122, the lip/ring 136 can at least partially engage the interior surface 139 of the sleeve 110 to substantially secure the firing tube 122 therein. In one embodiment, a lip/ring is additionally or alternatively provided at the lower end 156 of the firing tube 122.

FIG. 13 shows a step 340 for assembling the launcher assembly 100 upon formation of the firing tube 122. As shown in FIG. 13, the firing tube 122 can be at least partially received within the cavity 116 of the sleeve 110. For example, the firing tube 122 can be press-fitted, for example, using a machine press or other suitable mechanism, machine, tool, etc., at least partially into the cavity 139 of the sleeve 110. The lip/ring 136 of the firing tube 122 further can at least partially engage the interior surface 139 of the sleeve 110 to substantially secure the firing tube 122 therein. Additionally, the wadding portion 106 can be at least partially received within the passage 128 of the firing tube 122 at or substantially adjacent to a lower end 156 of the firing tube 122. For example, the wadding insert 106 can be press-fitted, for example using a machine press or other suitable mechanism, machine, tool, etc., into the firing tube 122 such that the wadding insert 106 is positioned substantially adjacent the lower end 156 of the firing tube 122.

Thereafter, as further shown in FIG. 13, the base 108 can be connected to the lower end 156 of the firing tube 122. In one embodiment, the projecting portion 162 of the base 108 can be at least partially aligned with the lower end 156 of the firing tube 122 and in some embodiments, may be at least partially received within the passage 128 of the firing tube 122. Then, the projecting portion 162 can be attached or secured to the firing tube 122 using one or more fasteners 166, e.g., nails, screws, rivets, etc., though any suitable fixing mechanism, such as an adhesive, soldering, welding, etc., can be employed without departing from the scope of the present disclosure.

The foregoing description of the disclosure illustrates and describes various exemplary embodiments. Various additions, modifications, changes, etc. could be made to the exemplary embodiments without departing from the spirit and scope of the claims. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A launcher assembly, comprising:

a sleeve having a cavity defined therethrough;

a firing tube at least partially received within the cavity of the sleeve, the firing tube comprising a passage defined therethrough and a plurality of rifling features defined about an interior surface thereof, the plurality of rifling features causing one or more aerial shells loaded into and launched from the firing tube to rotate or spin as the one or more aerial shells move along the firing tube during launching thereof, and the firing tube being formed from a metallic material;

a wadding insert received at least partially within the passage of the firing tube and positioned substantially adjacent to a lower end of the firing tube; and a base portion connected to a lower end of the firing tube and configured to maintain the launching assembly in a generally upright orientation before, during, and/or after launching of the one or more aerial shells therefrom.

2. The launcher assembly of claim 1, wherein the plurality of rifling features include one or more channels defined in the interior surface of the firing tube, and wherein the one or more channels are recessed at a prescribed depth in relation to the interior surface of the firing tube.

3. The launcher assembly of claim 2, wherein the one or more channels are arranged in a spiral or helical pattern at least partially along the interior surface of the firing tube.

4. The launcher assembly of claim 1, wherein the sleeve is formed from a plastic or paper-based material.

5. The launcher assembly of claim 4, wherein the base portion is formed from a plastic material.

6. The launcher assembly of claim 5, wherein the wadding insert is formed from cork.

7. The launcher assembly of claim 1, wherein the wadding insert at least partially dampens stresses generated from launching of the one or more aerial shells from the launcher assembly.

* * * * *